US007780771B2

(12) United States Patent
Scaraglino et al.

(10) Patent No.: US 7,780,771 B2
(45) Date of Patent: Aug. 24, 2010

(54) METALLIZATION OF DIELECTRICS

(75) Inventors: Frank Scaraglino, North Babylon, NY (US); Walter Sommer, Maspeth, NY (US); Neil D. Brown, Merrick, NY (US); Kai Wang, Hicksville, NY (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 931 days.

(21) Appl. No.: 11/634,062

(22) Filed: Dec. 5, 2006

(65) Prior Publication Data

US 2007/0128366 A1 Jun. 7, 2007

Related U.S. Application Data

(60) Provisional application No. 60/742,495, filed on Dec. 5, 2005.

(51) Int. Cl.
*C23C 18/24* (2006.01)

(52) U.S. Cl. ..... 106/1.05; 106/1.11

(58) Field of Classification Search ..... 106/1.05, 106/1.11

See application file for complete search history.

(56) References Cited

U.S. PATENT DOCUMENTS

| | | | | |
|---|---|---|---|---|
| 3,661,597 | A | 5/1972 | Gulla | |
| 3,765,936 | A | 10/1973 | Shipley, Jr., et at | |
| 3,847,658 | A | 11/1974 | Vincent et al | |
| 4,035,500 | A | 7/1977 | Dafter, Jr. | |
| 4,269,625 | A | 5/1981 | Molenaar | |
| 4,467,067 | A | 8/1984 | Valayil et al. | |
| 4,482,596 | A | 11/1984 | Gulla et al. | |
| 4,539,044 | A | 9/1985 | Abu-Moustafa et al. | |
| 4,550,036 | A | 10/1985 | Ludwig et al. | |
| 4,550,037 | A | 10/1985 | Kinkelaar et al. | |
| 4,592,929 | A | 6/1986 | Tubergen et al. | |
| 4,781,788 | A | 11/1988 | Forsterling et al. | |
| 5,143,544 | A | 9/1992 | Iantosca | |
| 5,160,600 | A | 11/1992 | Patel et al. | |
| 5,306,334 | A | 4/1994 | Martyak et al. | |
| 5,316,867 | A | 5/1994 | Chao et al. | |
| 5,413,817 | A | 5/1995 | Chao et al. | |
| 6,251,249 | B1 | 6/2001 | Chevalier et al. | |
| 6,322,686 | B1 | 11/2001 | Brown et al. | |
| 6,344,242 | B1 * | 2/2002 | Stolk et al. | 106/1.11 |
| 6,645,557 | B2 | 11/2003 | Joshi | |
| 6,736,886 | B2 | 5/2004 | Suda et al. | |
| 6,752,844 | B2 | 6/2004 | Miller et al. | |
| 6,776,828 | B2 | 8/2004 | Kanzler et al. | |
| 6,852,211 | B2 | 2/2005 | Kondo et al. | |
| 6,861,097 | B1 | 3/2005 | Goosey et al. | |
| 7,198,662 | B2 * | 4/2007 | Marumo | 106/1.05 |
| 2006/0042954 | A1 | 3/2006 | Yoshinaga et al. | |

FOREIGN PATENT DOCUMENTS

| | | | |
|---|---|---|---|
| EP | 0 625 590 | B1 | 9/1996 |
| EP | 0 913 498 | B1 | 5/2005 |
| WO | WO 03/052005 | A1 | 6/2003 |

* cited by examiner

*Primary Examiner*—Helene Klemanski
(74) *Attorney, Agent, or Firm*—John J. Piskorski

(57) ABSTRACT

A composition and method are disclosed. The composition both conditions and activates a dielectric material for metal deposition. The metal may be deposited on the dielectric by electroless methods. The metallized dielectric may be used in electronic devices.

4 Claims, No Drawings

METALLIZATION OF DIELECTRICS

The present invention is directed to the metallization of dielectrics. More specifically, the present invention is directed to the metallization of dielectrics using a composition and method to promote adhesion of metal to the dielectric and to catalyze the metallization of the dielectric.

Various methods for producing metallic patterns on dielectrics are known. Such methods include, alone or in various combinations, positive and negative printing processes, positive and negative etching techniques, electroplating and electroless plating.

Many conventional methods for metallizing dielectric substrates utilize aggressive oxidizing agents such as chromic acid as part of surface treatment prior to the steps of conditioning, catalyzation and electroless metal deposition. However, in addition to the hazards to workers as well as the environment, such processes are lengthy and time consuming. Industries which use electroless metallization methods desire processes which are short in duration to improve production efficiency and at the same time are environmentally friendly to avoid expensive hazardous waste disposal.

After oxidation an activation or catalyzation step is done prior to electroless deposition. A metal salt which is capable of reducing metal ions to metal is applied to a dielectric. The dielectric is then placed in an electroless bath where metal ions are reduced to metal to form metal layers on the dielectric substrate without the use of electrical current. Catalysts or activators, which serve as reduction catalysts in the electroless process, include noble metals such as palladium, platinum, gold, silver, iridium, osmium, ruthenium and rhodium. Typically palladium is the catalyst of choice because it provides the formation of uniform metal layers with high peel strengths on dielectric substrates. Also it may be used to electrolessly deposit a wide variety metals as well as metals important to various industries such as the electronics industry. Such metals include tin, copper, nickel and many of their respective alloys. Palladium often is provided commercially as a palladium/tin colloid. For example, U.S. Pat. No. 5,413,817 to Chao et al. discloses a method of adhering metal coatings to polyphenylene ether-polystyrene articles. Chao et al. initially contact the polyphenylene either-polystyrene articles with tetravalent cerium and nitric acid prior to activation with a palladium-containing catalyst solution.

While palladium has been the catalyst of choice in many electroless processes, the metal is expensive, the price at times exceeding the price of gold by a factor of two or more. Other less expensive metals such as silver have been tried. However, silver has presented difficulties. Silver often does not provide suitable catalytic activity or may result in less than optimum deposition. For these reasons silver has been generally in disfavor. Accordingly, there is a need for a method of electroless metallization which avoids the use of palladium.

In one aspect, compositions include one or more sources of cerium (IV) ions, one or more sources of silver (I) ions and one or more sources of hydrogen ions.

In another aspect, the compositions consist of one or more sources of cerium (IV) ions, one or more sources of silver (I) ions, one or more sources of hydrogen ions and water.

In a further aspect, a method includes providing a composition including one or more sources of cerium (IV) ions, one or more sources of silver (I) ions and one or more sources of hydrogen ions; contacting a dielectric with the composition to condition and activate the dielectric; and depositing a metal on the dielectric.

In an additional aspect, a method includes providing a composition including one or more sources of cerium (IV) ions, one or more sources of silver (I) ions, one or more sources of hydrogen ions; contacting a dielectric with the composition to condition and activate the dielectric; electrolessly depositing a first metal on the dielectric; and depositing a second metal on the first metal.

In another aspect, a method includes providing a composition including one or more sources of cerium (IV) ions, one or more sources of silver (I) ions, one or more sources of hydrogen ions; contacting a dielectric with the composition to etch the dielectric; and electrolessly depositing a metal on the dielectric.

The cerium and silver compositions may both condition a dielectric surface to provide a secure bond between a metal and the dielectric and catalyze the deposition of the metal onto the dielectric material. In another aspect, the cerium and silver compositions may etch the dielectric and autocatalyze it. Hazardous oxidizing agents such as chromic acid are avoided providing environmentally friendly compositions and methods for metallizing dielectrics. Also, in one aspect, since the use of chromic acid is avoided and the conditioning and catalyzing step are combined, the number of process steps is reduced to provide a more efficient method of metallizing dielectrics. Additionally, the addition of silver ions to the cerium etch improves adhesion of metal to the dielectric.

As used throughout this specification, the following abbreviations shall have the following meanings, unless the context indicates otherwise: ° C.=degrees Centigrade; g=gram; mg=milligram; L=liter; ml=milliliter; cm=centimeters; ppm=parts per million; 1 mil=25.4 microns; M=molar; v=volume; ASD=amperes/square decimeter; lbf=foot pounds; and in=inch.

The terms "depositing" and "plating" are used interchangeably throughout this specification. All percentages are by weight unless otherwise noted. All numerical ranges are inclusive and combinable in any order except where it is logical that such numerical ranges are constrained to add up to 100%.

Compositions include one or more sources of cerium (IV) ions, one or more sources of silver (I) ions and one or more sources of hydrogen ions. The combination of the cerium (IV) ions and the hydrogen ions conditions a dielectric surface to provide a secure bond between the dielectric and a metal deposited on the dielectric surface. Silver (I) ions catalyze the metal deposition onto the dielectric surface.

Any water soluble salt or complex which provides cerium (IV) ions may be used. Cerium (IV) ions may be provided by adding and mixing a complex double salt such as ammonium cerium nitrate $(NH_4)_2Ce(NO_3)_6$ in water. The ammonium cerium nitrate dissolves in the water to provide cerium (IV) ions ($Ce^{4+}$) in solution in the water. Other sources of cerium (IV) ions include, but are not limited to, cerium tetrasulfate $Ce(SO_4).\ 2H_2SO_4$, a double salt such as ammonium cerium sulfate $(NH_4)_4Ce(SO_4)_4.2H_2O$, cerium oxide ($CeO_2$), cerium sulfate ($Ce(SO_4)_2$) and cerium sulfate tetrahydrate ($Ce(SO_4)_2.\ 4H_2O$). In general, one or more salts or complexes are mixed with water to provide cerium (IV) ions in solution in amounts of 5 g/L to 500 g/L, or such as from 50 g/L to 350 g/L, or such as from 100 g/L to 250 g/L.

Any water soluble salt or complex which provides silver (I) ions ($Ag^+$) may be used. Sources of silver ions include, but are not limited to silver nitrate, silver tetrafluoroborate, silver perchlorate, silver fluoride, silver acetate, silver carbonate, silver oxide, silver sulfate and silver hydroxide. In general, one or more sources of silver (I) ions are included in amounts of 0.1 g/L to 50 g/L, or such as from 0.2 g/L to 30 g/L, or such as 0.5 g/L to 20 g/L, or such as from 1 g/L to 15 g/L.

Hydrogen ions may be provided by any suitable acid which in combination with cerium (IV) ions conditions the dielectric substrate. Typically inorganic acids are used and they provide the matrix for the compositions. Such inorganic acids include, but are not limited to, sulfuric acid, nitric acid, hydrochloric acid, hydrofluoric acid, phosphoric acid or mixtures thereof. Typically nitric acid or sulfuric acid is used. Most typically nitric acid is used to provide the composition matrix. One or more acids are included in the compositions in amounts of 50 g/L to 750 g/L, or such as from 50 g/L to 500 g/L, or such as from 100 g/L to 300 g/L.

The components of the cerium and silver compositions may be mixed together in water in any order. If desired, the mixtures may be heated up to 30° C. to initiate solubilization of one or more of the components otherwise the components may be mixed together at room temperature. The cerium and silver compositions are storage stable however optionally conventional antimicrobials may be added to prolong their storage life. Some precipitation of the components may occur during storage nevertheless the compositions may still be used or they may be heated to re-solubilize the components. The compositions include one or more sources of cerium (IV) ions, one or more sources of silver (I) ions, one or more sources of hydrogen ions and water. The pH of the compositions ranges from less than 1 to 5 or such as from 1 to 3. Typically, the pH is less than 1.

In addition to the one or more sources of cerium (IV) ions, silver (I) ions and acids, the compositions also may include additives to tailor their performance for a particular dielectric. Such additives include, but are not limited to, one or more surface active agents such as cationic, anionic, zwitterionic and non-ionic surface active agents. Such surface active agents may be used in conventional amounts. Typically they are used in amounts of 0.005 g/L to 10 g/L. Typically, the compositions consist of one or more sources of cerium (IV) ions, one or more sources of silver (I) ions and one or more sources of hydrogen ions The cerium (IV) and silver (I) compositions may be applied to a dielectric substrate by any suitable method to etch the dielectric. Such methods include, but are not limited to, immersing the dielectric substrate in a bath containing a cerium (IV) and Silver (I) composition, spraying the composition on the dielectric or brushing the composition on the dielectric. Typically the compositions remain in contact with the dielectric substrate for 5 minutes to 30 minutes, or such as from 10 minutes to 20 minutes. The dielectric is then rinsed with water.

The conditioning and activating process forms a surface to provide a means by which metal may form a secure bond with the dielectric surface. In such conditioning and activating processes the amount of salts or complexes which include cerium (IV) ions are used in amounts of from 5 g/L to 50 g/L, or such as from 20 g/L to 40 g/L. The sources of silver (I) ions are included in amounts as disclosed above. Such compositions are auto catalytic. Typically, the conditioned surface does not show any observable morphological change. As metal is deposited on the conditioned surface it forms secure bonds with the dielectric surface. Peels strengths may range from 1.7 g/mm to 175 g/mm or such as 10 g/mm to 120 g/mm or such as from 20 g/mm to 80 g/mm as measured with an Instron® Series 4400 materials testing instrument. The surface conditioning ability of the combination of the cerium (IV) and hydrogen ions eliminates the need for undesirable oxidizing compounds, such as chromic acid, which are both hazardous to workers and the environment.

Optionally, prior to conditioning a dielectric with a cerium and silver composition, the dielectric may be treated with a solvent swell. The dielectric may then be rinsed with water prior to conditioning with one of the compositions.

Conventional solvent swells may be used. An example of a commercially available solvent swell is Conditioner PM-920™ (available from Rohm and Haas Electronic Materials in Marlborough, Mass. U.S.A.). Different solvent swells are used for different types of dielectrics. For example, different polymers are susceptible to different solvents. Thus, some amount of trial and error may be required in order to optimize treatment of a dielectric. Solvents include, but are not limited to, glycol ether esters such as acetates, N-alkyl pyrrolidones, aliphatic alcohols, aliphatic amines, alkali metal hydroxides, butyl and ethyl Cellosolve® (2-butoxy ethanol), butyl Carbitol® (2-(2-butoxyethoxy) ethanol), and ethylene glycol. Other useful solvents include, but are not limited to, 2-butoxy ethyl acetate (EBA), propylene glycol monomethyl ether (Dowanol™ PM), propylene glycol monomethyl ether acetate (Dowanol™ PMA) and mixtures thereof.

Other solvent swells include, but are not limited to, amides (e.g. N,N-dimethylformamide and N-methyl-2-pyrrolidone), nitrites (e.g. acetonitrile), amines (e.g. triethanolamine), dimethyl sulfoxide, propylene carbonates and γ-butyrolactone, ethyl acetate, butyl acetate, benzaldehyde, ketones such as cyclohexanone, acetone, methyl ethyl ketone, acetic acid, carbon disulfide, and mixtures thereof.

Dielectrics which may be conditioned and activated with the compositions include, but are not limited to, thermoplastic resins, polyethylene resins such as high-density polyethylene, medium-density polyethylene, branching low-density polyethylene, straight-chain low-density polyethylene, or super high-molecular-weight polyethylene, polyolefin resins such as polypropylene resin, polybutadiene, polybutene resin, polybutylene resin, polystyrene resin, halogenated resins such as polyvinyl chloride resin, polyvinylidene chloride resin, polyvinylidene chloride-polyvinyl chloride polymer resin, chlorinated polyethylene, chlorinated polypropylene and tetrafluoroethylene, AS resins, ABS resins, MBS resins, polyvinyl alcohol resins, polyacrylic ester resins such as methyl polyacrylate, polymethylacrylic ester resins such as methyl polymethacrylate, methyl-methacrylate-styrene copolymer resins, maleic anhydride-styrene copolymer resins, polyvinyl chloride resins, cellulose resins such as cellulose propionate resins and cellulose acetate resins, epoxy resins, polyamide imide resins, polyallylate resins, polyether imide resins, polyether ether ketone resins, polyethylene oxide resins, polyester resins such as PET resin, polysulfone resins, polyvinyl ether resins, polyvinyl butyral resins, polyphenylene ether resins such as polyphenylene oxide, polyphenylene sulfide resins, polybutylene terephthalate resins, polymethylpentene resins, polyacetal resins, vinyl chloride-vinyl acetate copolymers, ethylene-vinyl acetate copolymers, ethylene-vinyl chloride copolymers, and copolymers and blends thereof, thermosetting resins, including epoxy resins, xylene resins, guanamine resins, diallyl phthalate resins, vinyl ester resins, phenolic resins, unsaturated polyester resins, furan resins, polyimide resins, polyurethane resins, maleic acid resins, melamine resins and urea resins and mixtures thereof.

In an alternative embodiment the cerium (IV) and silver (I) compositions may be used to etch and autocatalyze a dielectric. Such dielectrics are as described above. When etching is done, salts or complexes including cerium (IV) ions are added in amounts such that the cerium ions in solution range from 50 g/L to 500 g/L or such as from 60 g/L to 400 g/L or such as from 80 g/L to 300 g/L or such as from 100 g/L to 200 g/L.

Optionally, etching may be followed by further activation of the dielectric with a conventional catalyst pre-dip and conventional catalyst used in metal deposition. Any suitable conventional catalyst pre-dip and conventional catalyst may be used. Such catalyst pre-dips and catalysts are well known in the art and readily obtainable from the literature. A conventional catalyst pre-dip which may be used is Cataprep™ 404, obtainable from Rohm and Haas Electronic Materials, L.L.C. in Marlborough, Mass. An example of a conventional palladium catalyst is a suspension which includes palladium metal in varying degrees of colloidal form. It may be prepared by reducing palladous chloride with stannous chloride in an acid solution. Hydrochloric acid is present to prevent the reduced palladium from coagulating. Typically, palladous chloride is dissolved in a 1:1 solution of hydrochloric acid and distilled water; then, while agitating, stannous chloride in an amount 10 times as much by weight as the pallous chloride is added to reduce the palladium. Alternatively, the cerium (IV) and silver (I) composition may function as a catalyst.

Conventional accelerators may then be added. Such accelerators are well known in the art and are readily obtainable from the literature. An example of a conventional accelerator is a mild acid solution of hydrochloric acid or perchloric acid.

After the dielectric is conditioned and activated a metal is electrolessly deposited on the surface of the dielectric. Any metal which may be deposited by electroless or immersion deposition may be plated on the conditioned dielectric surface. Such metals include, but are not limited to, copper, nickel, tin, gold, silver and alloys of each of the metals may be deposited on the etched dielectric. Examples of alloys which may be plated are copper/tin, copper/gold, copper/silver/gold, nickel/phosphorous and tin/lead.

Conventional electroless baths may be used to deposit metal and metal alloys on the dielectrics. The baths may be made from descriptions in the literature or may be obtained commercially. Examples of commercially available electroless baths are C 3000™ Electroless Copper and Circuposit™ 71 Bath. Both are available from Rohm and Haas Electronic Materials.

Electroless baths may be applied to the conditioned and activated dielectric by any suitable method. Conventional methods of electroless metal deposition may be used. Typically the dielectric is immersed in the bath or sprayed onto the surface. The plating times may vary. Plating times depend on the thickness of the metal layer desired. Thicknesses may range from 0.5 microns to 50 microns, or such as from 5 microns to 30 microns, or such as from 10 microns to 20 microns. The metal or metal alloy deposit is conductive and blister free. Blisters are areas on the plated dielectric where the deposited metal film separates from the substrate resulting in an adhesion failure.

After electroless metal deposition the metal layer optionally may be treated with an acid rinse. Typically the acid rinse is a dilute solution of one or more inorganic acids. Such acids include, but are not limited to, sulfuric acid, nitric acid, hydrochloric acid, hydrofluoric acid or phosphoric acids. The acid rinse may be done at room temperature.

Optionally, the electroless metal layer may be plated with one or more electrolytic metal layers. Conventional electrolytic metal baths may be used as well as conventional deposition conditions. Metals which may be deposited on the electrolessly metallized dielectric include, but are not limited to, copper, chromium, nickel, tin, gold, silver, cobalt, indium, and bismuth. Metal alloys which may be electrolytically deposited include, but are not limited to, copper/tin, copper/gold/silver, copper/bismuth, copper/tin/bismuth, copper/nickel/gold, nickel/phosphorous, nickel/cobalt/phosphorous, tin/bismuth, tin/silver and gold/silver. Electrolytic baths for electrolytic metal deposition are known in the literature or many may be commercially obtained.

In electroplating the electrolessly metallized dielectric functions as a cathode. A soluble or insoluble anode is employed as a second electrode. Conventional pulse plating or direct current (DC) plating or a combination of DC and pulse plating may be employed. Current densities and electrode potentials may vary depending on the metal or metal alloy deposited. Generally, current densities range from 0.05 ASD to 100 ASD. Typically current densities range from 1 ASD to 50 ASD. Plating is continued until a desired metal thickness is achieved. Generally, electrolytically deposited metal layers range from 1 micron to 100 microns, or such as from 15 microns to 80 microns, or such as from 25 microns to 50 microns.

The cerium (IV) and silver (I) compositions and methods may be used to metallize dielectric substrates for articles which include, but are not limited to, optoelectronic components, decorative articles such as furniture fittings, jewelry, plumbing fixtures and automobile parts, flex circuitry, communication equipment such as cell phones, EMI shielding and RF shielding and computer parts in general.

The following examples further illustrate the invention but are not intended to limit the scope of the invention.

EXAMPLE 1

Comparative

An acrylonitrile butadiene-styrene copolymer (ABS) plaque obtained from General Electric Co. (General Electric Cycolac™ MG37EP-BK4500) having the dimensions 8 cm×9 cm was etched for 8 minutes at 70° C. with a hexavalent chromium treatment solution to roughen the surface of the plaque. The chromium treatment solution was composed of 490 g/L (9 mol %) chromic acid and 295 g/L (5.5 mol %) sulfuric acid and water. The plaque was then rinsed four times with deionized water to remove the chromic acid.

The plaque was immersed in an aqueous solution of Neutralizer PM™ 954 (obtainable from Rohm and Haas Company, Philadelphia, Pa. U.S.A.) at 45° C. for three minutes to reduce chromium (VI) to chromium (III) and rinsed with deionized water.

The plaque was then immersed in Cuposit Catalyst™ 44 (stannous chloride-palladium catalyst), obtainable from Rohm and Haas Company, to activate the plaque for electroless metallization. The temperature of the catalyst was 45° C. The plaque was immersed in the activator for two minutes and then rinsed twice with deionized water.

The activated plaque was then immersed in a bath containing Accelerator PM™ 964 (obtainable form Rohm and Haas Company) at 45° C. for two minutes followed by a deionized water rinse. The plaque was then electrolessly plated with copper at 60° C. Plating was done for 20 minutes to form a 0.5 microns thick layer of copper on the plaque. The composition of the aqueous bath is in Table 1 below:

TABLE 1

| COMPONENT | AMOUNT |
|---|---|
| Copper sulfate pentahydrate | 8 g/L |
| Formaldehyde | 3 g/L |
| Sodium hydroxide (25 wt % solution) | 10 ml/L |

TABLE 1-continued

| COMPONENT | AMOUNT |
|---|---|
| Ethylenediaminetetraacetic acid | 10 g/L |
| Triisopropanolamine | 2 g/L |

The copper coated plaque was rinsed with deionized water followed by spray rinsing with deionized water. The copper coated plaque was then electroplated with a 1.5 mils layer of copper from an aqueous acid electrolytic copper bath. The current density was 4 ASD. The pH of the bath was less than 1. A conventional electroplating apparatus was used. The bath used had the formula disclosed in Table 2 below:

TABLE 2

| COMPONENT | AMOUNT |
|---|---|
| Copper sulfate pentahydrate | 80 g/L |
| Sulfuric acid (98 wt %) | 225 g/L |
| Chloride (sodium chloride) | 50 ppm |
| Polyethylene oxide polymer (average molecular weight of 2200) | 1 g/L |
| Bissulfopropyl disulfide | 1 ppm |

The plaque was then baked for one hour at 80° C. in a conventional convection oven. The peel strength was then tested using an Instron® Series 4400 materials testing instrument. The peel strength was 89 g/mm.

Table 3 below outlines the twenty (20) steps used to prepare and deposit metal layers on the ABS plaque using the conventional process.

TABLE 3

| PROCESS STEP | TIME |
|---|---|
| Solvent swell | 55 seconds |
| Rinse | 55 seconds |
| Rinse | 55 seconds |
| Rinse and Spray | 55 seconds |
| Chrome Etch | 8 minutes |
| Rinse | 55 seconds |
| Rinse | 55 seconds |
| Rinse | 55 seconds |
| Rinse | 55 seconds |
| Reducer | 55 seconds |
| Rinse | 55 seconds |
| Activator | 2 minutes |
| Rinse | 55 seconds |
| Rinse | 55 seconds |
| Accelerator | 55 seconds |
| Rinse | 55 seconds |
| Electroless Copper plating | 5 minutes |
| Rinse | 55 seconds |
| Rinse + Spray | 55 seconds |
| Electrolytic acid copper plating | 5 minutes |
| Total | 34.7 minutes |

Numerous steps for metal plating are inefficient and undesirable in the industry where high production volume is desired.

EXAMPLE 2

An ABS copolymer having dimensions 8 cm×9 cm was treated in Crownplate™ Conditioner PM-920 (obtainable from Rohm and Haas Company) at room temperature for 1 minute. The plaque was then rinsed with deionized water for 1 minute.

The plaque was then conditioned and activated with an aqueous solution containing 5 g/L of silver nitrate, 30 g/L of ammonium cerium (IV) nitrate and 600 ml/L of (95%) nitric acid. The pH of the conditioner-activator composition was less than 1. Conditioning and activation of the ABS plaque was done at 65° C. for 15 minutes. The plaque was then rinsed with deionized water for 2 minutes.

A copper layer was electroless plated on conditioned and activated plaque with the aqueous electroless bath in Table 4 below.

TABLE 4

| COMPONENT | AMOUNT |
|---|---|
| Copper sulfate pentahydrate | 8 g/L |
| Sodium hydroxide | 4 g/L |
| Formaldehyde | 3 g/L |
| Ethylenediaminetetraacetic acid | 10 g/L |
| Triisopropanolamine | 2 g/L |

Electroless deposition of copper was done at 70° C. for 20 minutes to form a copper layer on the plaque of 1 micron. The copper plated plaque was then rinsed with dilute sulfuric acid for one minute.

The copper plated plaque was then electroplated to a thickness of 1.5 mils from an acid copper electroplating bath as shown in Table 2 in Example 1.

The plaque was then baked for one hour at 80° C. in a conventional convection oven. The peel strength was then tested using an Instron® Series 4400 materials testing instrument. The peel strength was 112 g/mm.

Table 5 below outlines the seven (7) steps used to prepare and deposit metal layers on the ABS plaque using a method of the invention.

TABLE 5

| PROCESS STEPS | TIME |
|---|---|
| Solvent swell | 1 minute |
| Rinse | 1 minutes |
| Chrome-free conditioning and Activation | 15 minutes |
| Rinse | 1 minutes |
| Electroless copper plating | 10 minutes |
| Acid rinse | 1 minutes |
| Electrolytic acid copper plating | 5 minutes |
| Total | 34 minutes |

The process of the present example provided a conductive copper layer on which copper was deposited without the need to use hazardous and environmentally unfriendly chromic acid and the costly palladium catalyst as the process in Example 1. Further the present process reduced the number of steps from twenty to only seven thus, providing a more efficient process.

EXAMPLE 3

An ABS plaque 8 cm×9 cm is immersed in a conditioner-activator solution containing 10 g/L silver nitrate, 50 g/L ammonium cerium (IV) nitrate and 350 ml/L (95%) nitric acid. The pH of the etch-activator composition is less than 1. Conditioning and activation of the ABS plaque is done at 65° C. for 20 minutes. The plaque is then rinsed with deionized water for 1 minute.

The ABS plaque is then immersed in an electroless copper bath having the formula disclosed in Table 6 below:

TABLE 6

| COMPONENT | AMOUNT |
|---|---|
| Copper nitrate trihydrate | 12 g/L |
| Formaldehyde | 3 g/L |
| Sodium Hydroxide | 4 g/L |
| Ethylenediaminetetraacetic acid | 40 g/L |
| Sodium silicate | 2 g/L |

Electroless copper plating is done for 10 minutes at 70° C. to provide a 0.5 microns thick adherent layer of copper.

The copper plated plaque is then electrolytically plated with nickel to a thickness of 1 mil from a nickel electroplating bath having the formulation disclosed in Table 7 below:

TABLE 7

| COMPONENT | AMOUNT |
|---|---|
| Nickel sulfate hexahydrate | 180 g/L |
| Nickel chloride hexahydrate | 90 g/L |
| Boric acid | 45 g/L |

Electrolytic plating of nickel is done at 3 ASD at a temperature of 60° C. for 1 hour. The process sequence is expected to result in a bright, adherent metal deposit securely bonded to the plaque.

EXAMPLE 4

A 10 cm×10 cm polyphenylene ether-polystyrene plaque is treated with an N-methyl-2-pyrrolidone solvent swell. This is done for 2 minutes at room temperature. The plaque is then rinsed for 5 minutes in deionized water.

The plaque is then conditioned and activated with an aqueous composition containing 40 g/L ammonium cerium (IV) nitrate, 20 g/L silver fluoroborate and 400 ml/L (95%) nitric acid. Conditioning and activation are done for 15 minutes at 65° C. The coupon is then rinsed with deionized water for 5 minutes.

The conditioned and activated plaque is then immersed in an electroless copper bath having the formula in Table 8 below:

TABLE 8

| COMPONENT | AMOUNT |
|---|---|
| Copper sulfate pentahydrate | 12 g/L |
| Formaldehyde | 4 g/L |
| Sodium hydroxide | 8 g/L |
| Quadrol | 20 g/L |
| Sodium cyanide | 5 ppm |

Electroless cooper plating is done for 15 minutes at 45° C. to form a copper film on the plaque with a thickness of 0.5 microns. The plaque is then rinsed with a dilute sulfuric acid rinse for 2 minutes.

The copper plated plaque is then electroplated with tin using an aqueous, acid tin electrolyte bath in Table 9 below:

TABLE 9

| COMPONENT | AMOUNT |
|---|---|
| Tin ions from tin methane sulfate | 15 g/L |
| Methane sulfonic acid | 40 g/L |
| Ethylene oxide/propylene oxide copolymer | 0.5 g/L |

TABLE 9-continued

| COMPONENT | AMOUNT |
|---|---|
| Polyethylene glycol | 0.5 g/L |
| Hydroquinone | 250 ppm |

Electrolytic plating of tin is done at 30 ASD at a temperature of 55° C. for 15 minutes. The thickness of the tin layer is 2 mils.

No blisters are expected to be observed on the tin layer and the metal layers are expected to be securely bonded to the plaque.

EXAMPLE 5

A 10 cm×15 cm high density polyethylene coupon is treated for 1 minute using propylene glycol monomethyl ether (Dowenol™ PM). This is done at room temperature. The coupon is then rinsed with deionized water for 1 minute.

The coupon is conditioned and activated with an aqueous composition composed of 40 g/L of cerium tetrasulfate, 500 ml/L of (95%) nitric acid and 10 g/L of silver nitrate. The pH of the solution is less than 1. Conditioning and activation are done for 10 minutes at a temperature of 70° C. The coupon is then rinsed with deionized water.

The conditioned and activated coupon is then immersed in an electroless copper bath having the formula in Table 10 below:

TABLE 10

| COMPONENT | AMOUNT |
|---|---|
| Copper sulfate pentahydrate | 10 g/L |
| Formaldehyde 37% | 20 ml/L |
| Sodium hydroxide 50% | 20 ml/L |
| Ethylenediaminetetraacetic acid | 35 g/L |

Electroless copper plating is done for 30 minutes at 65° C. to form a 0.75 microns copper film on the coupon. The coupon is then rinsed in deionized water for 2 minutes.

The copper plated coupon is then electroplated with a tin-nickel alloy using an aqueous, acid tin-nickel alloy plating bath in Table 11 below:

TABLE 11

| COMPONENT | AMOUNT |
|---|---|
| Stannous tin | 30 g/L |
| Nickel | 70 g/L |
| Total Fluorine | 35 g/L |
| Free hydrofluoric acid | 8 g/L |

Electrolytic plating of tin-nickel alloy is done at 2 ASD for 10 minutes at a temperature of 50° C. The thickness of the tin-nickel layer is 1 micron.

No blisters are expected to be observed on the tin-nickel layer and the metal layers are expected to be securely bonded to the coupon.

EXAMPLE 6

An aqueous cerium (IV) and silver (I) etch composition is made from 400 ml/L nitric acid, 300 g/L cerium ammonium nitrate and 10 g/L of silver nitrate. The composition is used to etch a 10 cm×15 cm high density polyethylene coupon to prepare it for metallization. Table 12 below provides an outline of the metallization process using the cerium (IV) and silver (I) composition.

TABLE 12

| Process Step | Process Parameters | Time |
|---|---|---|
| Etch composition applied to dielectric + rinse with water | 70° C. | 10-20 minutes |
| Pre-dip Cataprep ™ 404 | Room temperature | 1 minute |
| Palladium/tin catalyst + rinse with water | 44° C. | 5-10 minutes |
| Perchloric acid accelerator + rinse with water | 44° C. | 1-2 minutes |
| Electroless copper bath + rinse with water | 30° C. | 5-10 minutes |
| Sulfuric acid dip | Room temperature | 1-2 minutes |
| Acid copper electroplate + rinse with water | 4 ASD | 20-40 minutes |
| Semi-bright nickel electroplate | 3 ASD | 20-30 minutes |
| Bright nickel electroplate + rinse with water | 3 ASD | 10-20 minutes |
| Bright chrome (III) electroplate | 10 ASD | 2-10 minutes |

The electroplating baths are conventional. Etching of the dielectric material with the cerium (IV) and silver (I) etch is expected to enable a strong adhesive bond between the copper layer deposited electrolessly and the dielectric material.

What is claimed is:

1. A composition consisting of one or more sources of cerium (IV) ions in amounts of 5 g/L to 500 g/L, one or more sources of silver(I) ions in amounts of 0.1 g/L to 50 g/L, one or more sources of hydrogen ions and water.

2. The composition of claim 1, wherein the one or more sources of cerium (IV) ions are selected from the group consisting of ammonium cerium nitrate, cerium tetrasulfate, ammonium cerium sulfate, cerium oxide, cerium sulfate and cerium sulfate tetrahydrate.

3. The composition of claim 1, wherein the one or more sources of silver ions are selected from the group consisting of silver nitrate, silver tetrafluoroborate, silver perchlorate, silver fluoride, silver acetate, silver carbonate, silver oxide, silver sulfate and silver hydroxide.

4. The composition of claim 1, wherein the one or more sources of hydrogen ions selected from the group consisting of sulfuric acid, nitric acid, hydrochloric acid, hydrofluoric acid and phosphoric acid.

* * * * *